US006464784B1

(12) United States Patent
Piccinino, Jr. et al.

(10) Patent No.: US 6,464,784 B1
(45) Date of Patent: Oct. 15, 2002

(54) COATING APPARATUS HAVING A COATING, RECIRCULATION AND CLEANING ARRANGEMENT

(75) Inventors: Ralph L. Piccinino, Jr., Rush, NY (US); Kevin H. Blakely, Rochester, NY (US)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 09/470,065

(22) Filed: Dec. 22, 1999

(51) Int. Cl.[7] ..... B05C 1/00

(52) U.S. Cl. ..... 118/203; 118/602; 118/261

(58) Field of Search ..... 118/602, 603, 118/249, 250, 261, 262, 70, 203, 204, 216, 267, 266, 269; 396/630, 631, 626, 625, 604, 608, 606; 15/256.51; 101/423, 424, 425, 350.5

(56) References Cited

U.S. PATENT DOCUMENTS 2,944,484 A * 7/1960 Bruce
3,800,702 A * 4/1974 Roberto ..... 101/425
3,824,615 A 7/1974 Shintani et al.
4,270,450 A * 6/1981 Difflipp et al.
4,829,330 A 5/1989 Yamada et al.
4,943,823 A 7/1990 Uchiyama et al.
5,080,013 A * 1/1992 John
5,367,982 A * 11/1994 De Moore et al.
5,575,211 A * 11/1996 Harrison ..... 118/70
5,732,287 A 3/1998 Morse
5,875,370 A 2/1999 Patton et al.

* cited by examiner

*Primary Examiner*—Brenda A. Lamb
(74) *Attorney, Agent, or Firm*—David A. Novais

(57) ABSTRACT

An apparatus and method for applying at least one coating solution of a predetermined viscosity to a photosensitive material. The apparatus includes at least an application roller which is adapted to apply the coating solution onto the photosensitive material. A solution supply guide is positioned relative to the application roller to supply coating solution onto the application roller. The apparatus and method further includes a washing arrangement for washing the coating apparatus in an efficient manner. The washing arrangement includes a movable scrubber bar arrangement which retracts away from the application roller when the coating apparatus is in a coating mode of operation, and is movable to contact the application roller by way of brushes in a cleaning mode of operation. The apparatus and method further includes a recirculation system which alternatively supplies coating solution to the supply guide and cleaning solution to at least the washing arrangement.

11 Claims, 6 Drawing Sheets

COATING APPARATUS HAVING A COATING, RECIRCULATION AND CLEANING ARRANGEMENT

CROSS REFERENCE TO RELATED APPLICATIONS

The present application is related to U.S. applications Ser. No. 09/082,957 filed May 21, 1998, titled A METHOD AND APPARATUS FOR APPLYING A SOLUTION TO PHOTOSENSITIVE MATERIAL BY Ralph L. Piccinino Jr. and Kevin H. Blakely; U.S. Pat. No. 6,058,621 issued May 9, 2000, titled APPARATUS AND METHOD FOR DRYING PHOTOSENSITIVE MATERIAL USING RADIANT HEAT AND AIR FLOW PASSAGES by Ralph L. Piccinino Jr., Kevin H. Blakely, Daniel C. Davis and Raymond E. Wess; U.S. Pat. No. 6,092,303 issued Jul. 25, 2000, titled APPARATUS AND METHOD FOR DRYING PHOTOSENSITIVE MATERIAL USING A RADIANT SECTION AND AN AIR FLOW SECTION by Ralph L. Piccinino Jr., Kevin H. Blakely, Daniel C. Davis and Raymond E. Wess; U.S. Pat. No. 5,984,539 issued Nov. 16, 1999, titled A METHOD AND APPARATUS OF APPLYING A SOLUTION OF A PREDETERMINED VISCOSITY TO PHOTOSENSITIVE MATERIAL TO FORM A PROTECTIVE COATING THEREON; U.S. Pat. No. 5,905,924 issued May 18, 1999, titled REPLACEABLE CARTRIDGE COATING ASSEMBLY AND METHOD OF COATING A PHOTOSENSITIVE MATERIAL USING THE SAME; U.S. Pat. No. 5,875,370 issued Feb. 23, 1999, titled A COATING APPARATUS HAVING A REMOVABLE COATING MODULE FOR APPLYING A PROTECTIVE COATING TO PHOTOSENSITIVE MATERIAL and U.S. Application Ser. No. 09/470,639 filed Dec. 22, 1999 titled A COATING APPARATUS HAVING A CASCADE WALL AND METERING BLADE, AND A CLEANING AND RECIRCULATION ARRANGEMENT FOR THE COATING APPARATUS by Ralph L. Piccinino Jr. and Kevin H. Blakely.

FIELD OF THE INVENTION

The present invention relates to an apparatus for applying at least one coating solution of a predetermined viscosity to a photosensitive material, as well as a cleaning and recirculation arrangement for the coating apparatus.

BACKGROUND OF THE INVENTION

A coating apparatus as described in, for example, U.S. Pat. No. 5,984,539 generally applies a solution of a predetermined viscosity to photosensitive material, preferably processed photosensitive material, to form a protective overcoat on at least one surface of the photosensitive material. In order to apply a protective coating to an emulsion surface of a photosensitive material, control of the thickness, uniformity and laydown amount of the coating being applied is needed in order to provide for adequate protection against moisture and scratches. The control is needed for several reasons: 1) the protective coating must be applied in a manner that ensures that the surface is uniformly coated so that the coating can provide adequate protection to the entire surface; 2) the thickness of the coating must be controlled because if the coating is too thick, it could cause cracking, due to non-uniform drying; 3) a thick coating could dull the surface and the underlying image of the photographic print; 4) the coating solutions can be of different viscosities.

Generally, a coating apparatus as disclosed in, for example, U.S. application Ser. No. 09/082,957 filed May 21, 1998, which discloses one type of coating apparatus, utilizes a roller arrangement for applying a solution of predetermined viscosity to a surface of photosensitive material. The solution needs to be applied in a manner which provides for an even thickness of solution on the photosensitive material. These solutions in some cases can harden over a period of time within the coating apparatus. If the components, such as the rollers, of the coating apparatus become dirty with excess coating solution, they can leave artifacts on the photosensitive material. The cleaning of these components effects the efficiency of the coating apparatus by increasing the downtime of the apparatus. Therefore, it is advantageous to provide for a coating apparatus that is capable of applying an even coating on the photosensitive material, and which further includes a mechanism for quickly and efficiently cleaning the components of the coating apparatus.

SUMMARY OF THE INVENTION

The present invention provides for a novel apparatus and method which can apply a solution of a predetermined viscosity to at least one surface of photosensitive material, preferably processed photosensitive material, prior the final drying of the photosensitive material, to form a protective overcoat. In the present invention, the solution can be uniformly applied to the surface of the photosensitive material at a specific thickness.

The present invention further provides for a cleaning arrangement, which is capable of efficiently cleaning the components of the coating apparatus so as to minimize any artifacts on the photosensitive material.

The present invention further provides for a recirculation system which is capable of alternately supplying coating solution and/or cleaning solution to the coating apparatus in an efficient manner, so as to minimize down time of the coating apparatus during a cleaning operation.

The present invention provides for an apparatus for applying at least one coating solution to a photosensitive material. The apparatus comprises a support structure; first and second rollers rotatably mounted on the support structure so as to define a nip therebetween; a solution supply guide positioned relative to one of the first and second rollers to supply coating solution to the one roller, with the one roller applying coating solution to the photosensitive material as the photosensitive material passes the nip; and a washing arrangement mounted relative to the one roller to supply a cleaning solution onto at least a surface of the one roller.

The present invention further provides for a cleaning assembly for a coating apparatus, with the coating apparatus having at least one roller which applies a coating solution supplied to the coating apparatus to a photosensitive material. The cleaning assembly comprises a washing arrangement for washing at least the one roller of the coating apparatus; and a recirculation system adapted to supply a cleaning solution to the washing arrangement and prevent a supply of coating solution to the coating apparatus when the cleaning solution is being supplied to the washing arrangement.

The present invention further provides for a method of cleaning a coating apparatus, with the coating apparatus having at least one roller which applies at least one coating solution supplied to the coating apparatus to a fhotosensitive material. The method comprises the steps of stopping the supply of the at least one coating solution to the coating apparatus; positioning a washing arrangement at a washing position relative to the one roller so as to permit a supply of cleaning solution to at least the one roller; supplying the cleaning solution by way of the washing arrangement to at least the one roller; and moving the washing arrangement to a position different than the washing position when the supplying of the cleaning solution has stopped.

The present invention further provides for a photoprocessing system which comprises a processor for processing photosensitive material; and a coating apparatus for applying at least one coating solution to the processed photosensitive material. The coating apparatus comprises at least one roller mounted on a support structure; a coating solution supply guide positioned relative to the one roller to supply coating solution to the one roller; and a washing arrangement mounted relative to the one roller to supply a cleaning solution to the one roller.

The present invention further provides for a method of cleaning a coating apparatus that is adapted to apply at least one coating solution supplied to the coating apparatus to a photosensitive material. The method comprises the steps of stopping a supply of the at least one coating solution to the coating apparatus when it is desired to clean components of the coating apparatus from coating solution thereon; supplying a cleaning solution to the coating apparatus while the supply of coating solution is stopped so as to remove coating solution from the components of the coating apparatus; and stopping the supplying of the cleaning solution to the coating apparatus when the components of the coating apparatus are substantially clean of coating solution.

DETAILED DESCRIPTION OF THE INVENTION

Figure 1A:
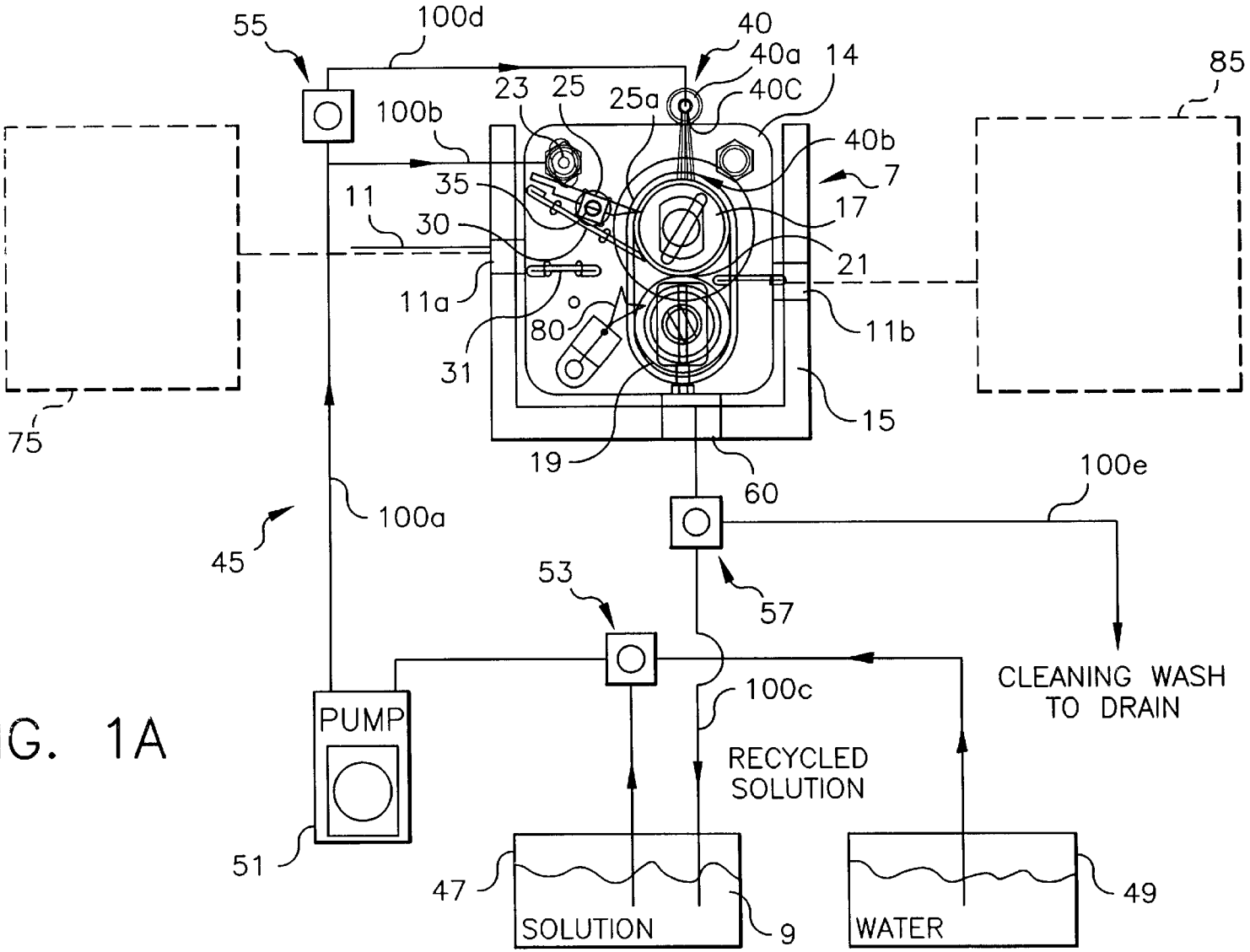
FIG. 1A is a schematic illustration of a coating apparatus, recirculation arrangement and cleaning arrangement in accordance with the present invention.
Figure 1B:
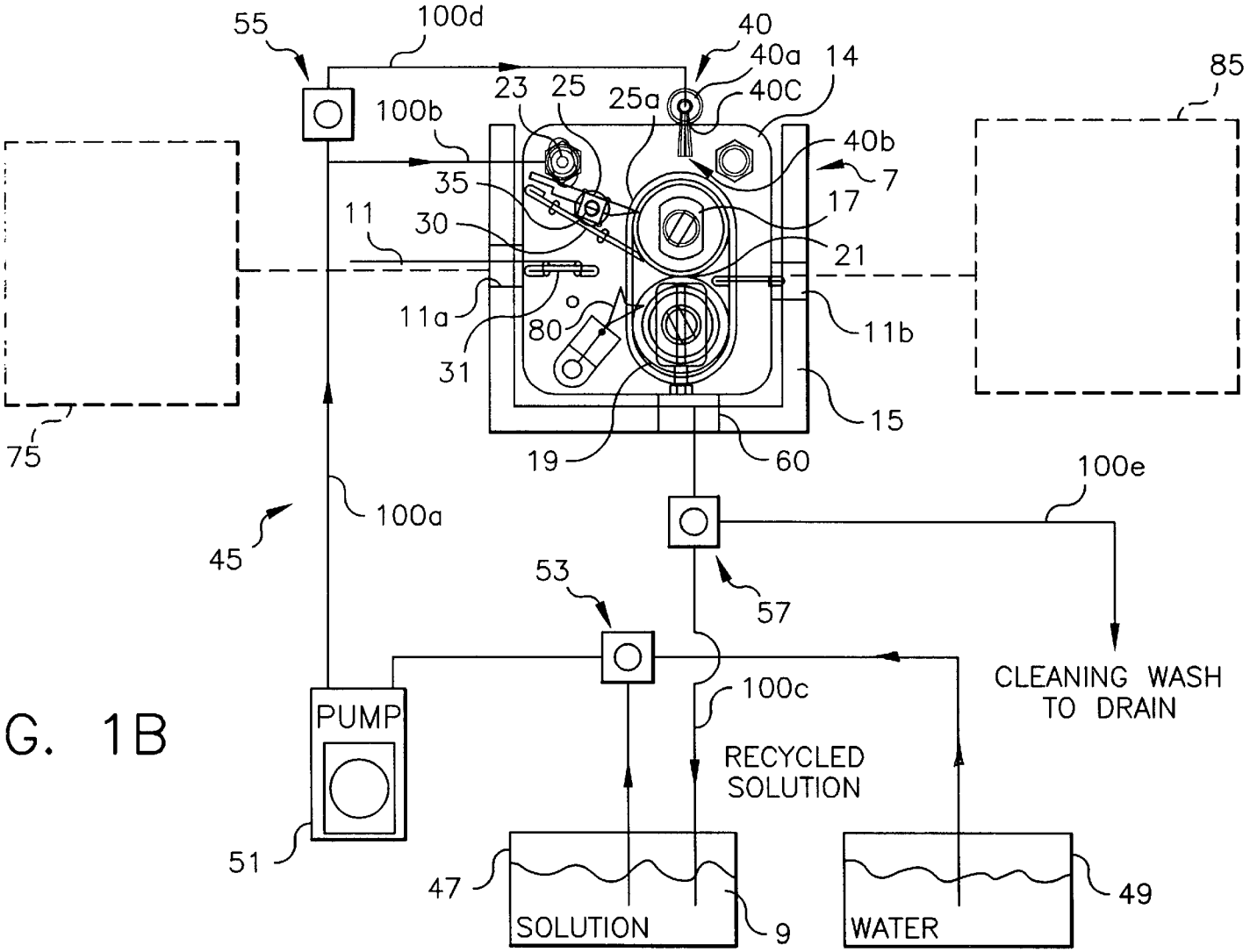
FIG. 1B is similar to FIG. 1A but shows the cleaning arrangement retracted away from an application roller.

Referring now to the drawings, wherein like reference numerals represent identical or corresponding parts throughout the several views, FIGS. 1A and 1B schematically illustrates a coating apparatus 7 for applying a layer of coating solution 9 of a predetermined viscosity to photosensitive material 11 prior to a drying of photosensitive material 11. In the system of the present invention, coating solution 9 can be held in a coating solution tank 47; while photosensitive material 11 is conveyed, emulsion side up, into coating apparatus 7 through an opening 11*a*. Photosensitive material 11 can be a processed photosensitive material and can be in the form of a photographic print, a web, a cut sheet or film. Coating solution 9 when dried will form a protective coating on photosensitive material 11 which exhibits at least moisture-proof properties. Coating apparatus 7 can be added to the end of an existing processing device as an accessory (for example, a stand-alone device), can be built in as part of a new processor, or retrofit into an existing processor.

With respect to the properties of coating solution 9, reference is made to co-pending U.S. Pat. Nos. 5,984,539; 5,905,924; and 5,875,370. Since coating solution 9 is to be applied in a minilab or photographic processing center, water based solutions that are substantially free of volatile organic compounds are preferred. However, it is recognized that numerous coating solutions can be utilized and that the type of coating solution applied is based on design considerations in view of the desired viscosity and waterproofing properties of the applied coating.

As illustrated in FIG. 1, coating apparatus 7 includes a support structure which comprises a rack 14 that is provided within a tank 15. Mounted to rack 14 in a rotatable manner are first and second rollers 17 and 19. Roller 17 is preferably an application roller in the form of a wired metering roller, while roller 19 is preferably a pinch roller. Rollers 17 and 19 are mounted on rack 14 so as to define a nip 21 therebetween for the passage of photosensitive material 11 therethrough. Although a rack and tank are shown, the support structure is not limited thereto, and it is recognized that numerous support structures, modules, or housing arrangements can be utilized.

Rack 14 further includes a coating solution supply entry port 23 through which coating solution 9 is supplied onto a solution supply guide 25. Solution supply guide 25 leads coating solution onto a surface of roller 17 which rotates in the direction of arrow 27*a* as illustrated more clearly in FIG. 2, to apply coating solution onto photosensitive material 11 at nip 21. It is recognized that some coating solution will be applied onto photosensitive material 11 prior to nip 21; however, it is noted that a metering or control of the amount of coating solution applied on photosensitive material 11 will occur at nip 21.

Figure 3:
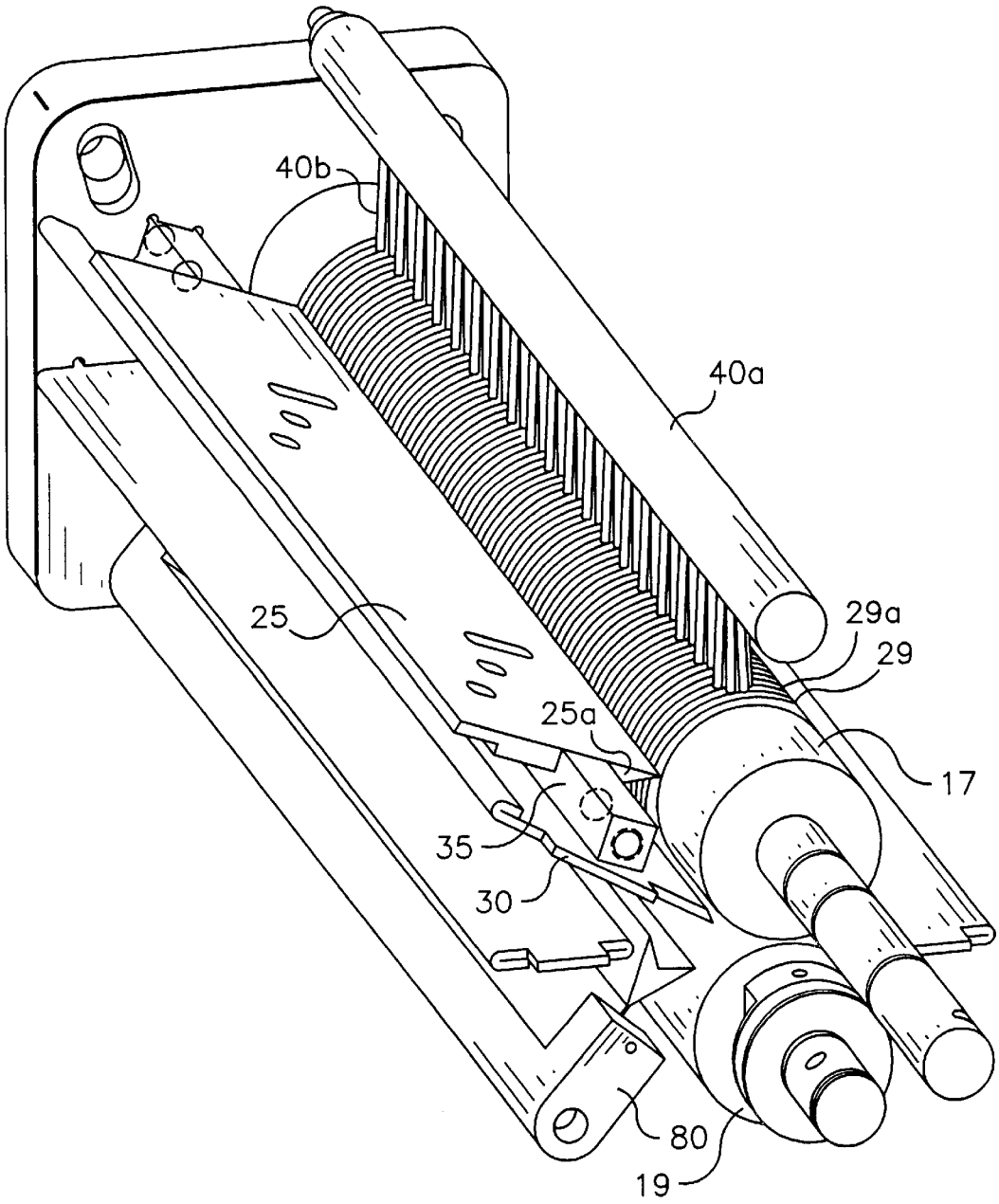
FIG. 3 is a perspective view of the coating apparatus and washing arrangement of FIG. 2.
Figure 4A:
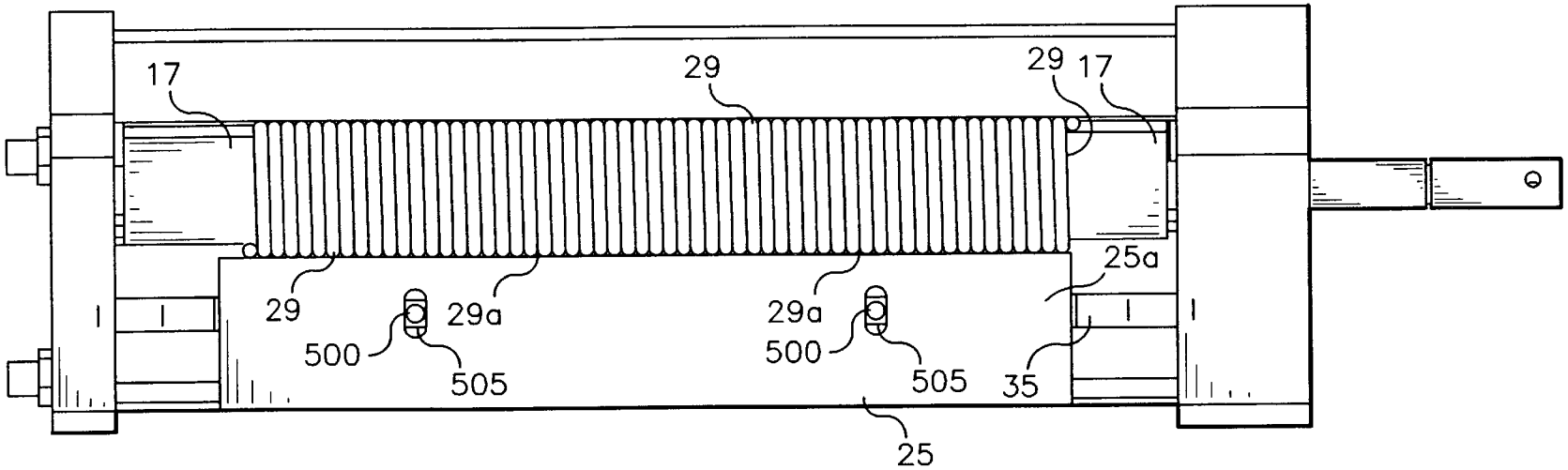
FIG. 4A is a side view of the application roller of the coating apparatus, as well as a supply guide in accordance with the present invention.
Figure 4B:
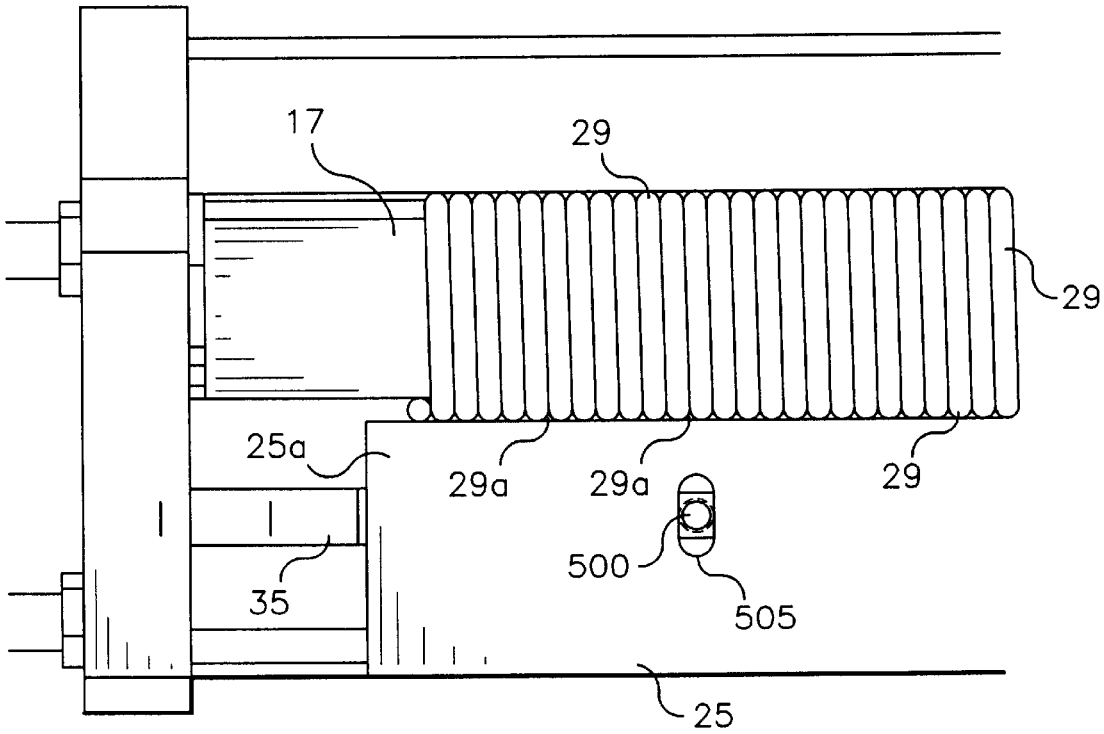
FIG. 4B is a detailed view of the application roller and supply guide of FIG. 4A.

As illustrated in FIGS. 3 and 4A, 4B, roller 17 is preferably a wired roller which includes a wire or wires 29 wrapped around a surface of roller 17. Solution supply guide 25 extends to a surface of roller 17 at a location upstream of nip 21, with respect to the direction of rotation 27*a* of roller 17, so as to contact or be slightly spaced from the top surface of wire or wires 29 wrapped around roller 17. With this arrangement, coating solution is supplied onto the surface of roller 17 by way of solution supply guide 25, which is positioned at an angle so as to permit a down flow of coating solution toward roller 17. Supply guide 25 further skims extra coating solution which extends above the surface of wire 29.

More specifically, as illustrated in FIG. 3, supply guide 25 includes a triangular portion 25*a* which abuts against or is slightly spaced from (depending on the amount of metering desired) the top surface of wire 29, so that the coating solution will be applied into spaces 29*a* (illustrated in FIGS. 4A and 4B) between wire 29. Triangular portion 25*a* of supply guide 25 will skim off any excess coating solution that extends above the top surface of wire 29 and maintain the coating solution in spaces 29*a*. This permits a precise and controlled supply of coating solution onto roller 17 which applies an even coating of solution onto photosensitive material 11 as it passes nip 21 between roller 17 and roller 19. To further control the amount of metering by way of supply guide 25, supply guide 25 can be made adjustable to move toward and away from the surface of roller 17. More specifically, supply guide 25 can include screws, bolts or the like 500 provided within slots 505. When it is desired to adjust the position of supply guide 25, the screws bolts or the like 500 can be loosened to permit a sliding movement of supply guide 25 within a distance defined by slot 505. After the desired position of guide 25 with respect to the surface of roller 17 is achieved, the screws, bolts or the like 500 are tightened.

Referring back to FIGS. 1A, 1B and 2, in an embodiment of the present invention, rack 14 can include an upper guide 30 and a lower guide 31 which guide photosensitive material 11 to nip 21. In a further feature of the invention, upper guide 30 includes a plate portion 35 which serves as a mount for supply guide 25, so as to position triangular portion 25*a* relative to the top surface of wire 29. Further, upper guide 30 can serve as a downstream skimmer, with respect to guide 25, so as to skim away any excess coating solution that extends above the surface of wire 29 that is not skimmed by supply guide 25.

As further illustrated in FIGS. 1A, 1B, 2 and 3, the present invention includes a washing arrangement 40 through which cleaning solution, such as water, is supplied onto at least roller 17. Washing arrangement 40 is in the form of a retractable scrubber assembly that comprises a scrubber bar 40*a* with brushes 40*b* extending therefrom. Washing arrangement 40 further includes a discharge opening or openings 40*c* which open to brushes 40*b* so as to discharge cleaning solution through brushes 40*b* onto at least the surface of roller 17.

Therefore, with the use of coating apparatus 7, as illustrated in FIG. 1, photosensitive material 11, such as processed photosensitive material, after exiting the last station of a processing assembly 75, is introduced into coating apparatus 7 by way of entry port 11*a*. Processing assembly 75 could be part of a known processing system which includes a series of tanks that include developer solution, bleach solution, fixer solution and washing solution; or a combination of bleach/fix solution and wash/stabilizer solution. Each of the tanks would thereby represent steps in the developing process. After entering coating apparatus 7, photosensitive material 11 is guided by the combination of guides 30 and 31 into nip 21 between rollers 17 and 19. Coating solution 9 is supplied by way of entry port 23 onto supply guide 25 which supplies the coating solution onto roller 17 so as to fill within spaces 29*a* between wire 29. Triangular portion 25*a* of supply guide 25 serves to skim off solution which extends above wire 29. Further, guide member 30 can remove any excess solution which is not skimmed off by supply guide 25. Roller 17 which rotates in direction 27*a* (FIG. 2), will thereafter apply the coating solution onto photosensitive material 11 at nip 21 between rollers 17 and 19. That is, roller 17 applies a desired amount of coating solution in a controlled manner and leaves a desired thickness of coating solution on photosensitive material 11. Additionally, by introducing the coating solution by way of guide 25 at a height which is generally about in a vicinity of a rotational axis of roller 17, an uneven application of solution onto photosensitive material is prevented. That is, this arrangement (the positioning of supply guide 25 upstream of nip 21 and generally in a vicinity of the rotational axis of roller 17) permits an application of coating solution onto photosensitive material while avoiding the application of excess coating solution. After the coating solution is applied onto photosensitive material 11, photosensitive material 11 will exit coating apparatus 7 via exit port 11*b*.

Figure 2:
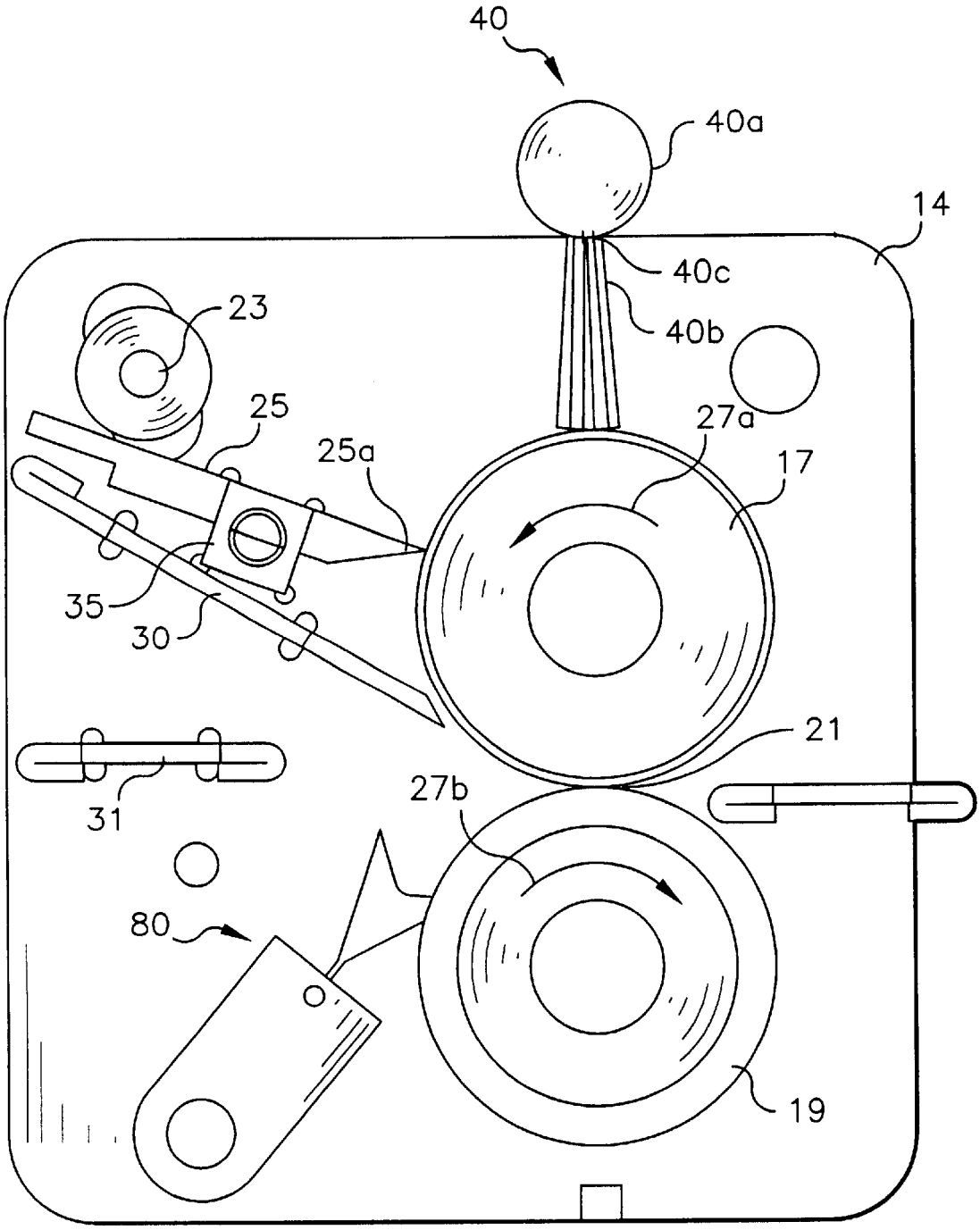
FIG. 2 is an isolated view of the coating apparatus and a washing arrangement in accordance with the present invention.

As solution flows down roller 17, the solution will eventually follow the rotation (arrow 27*b*, FIG. 2) of roller 19. With the arrangement of the present invention, a wiping blade 80 as illustrated in FIGS. 1 and 2 catches solution on roller 19 and stops the solution from returning back to nip 21. This prevents the application of solution onto the back side of photosensitive material 11. This is enhanced by spring loading wiping blade 80 against the surface of roller 19. Any excess solution will flow downward, and will be delivered to the bottom of tank 15.

As indicated above, after the coating solution is applied to photosensitive material 11, coated photosensitive material 11 exits coating apparatus 7 by way of exit port 11*b*. After leaving exit port 11*b*, the coated photosensitive material can be transferred to a dryer 85 schematically illustrated in FIGS. 1A and 1B. Dryer 85 can be a dryer which dries photosensitive material 11 by way of, for example, air blowers as described in U.S. application Ser. Nos. 09/092,593 and 09/092,841.

Referring now to washing arrangement 40, a feature of washing arrangement 40 is that it is movable in a direction towards roller 17 so that brushes 40*b* touch the surface of roller 17 and enter into spaces 29*a* between wire 29 (FIG. 1A); and is movable or retractable away from roller 17 (FIG. 1B) so that brushes 40*b* are at least spaced from the surface of roller 17.

The arrangement of the present invention further includes a recirculation system illustrated generally by reference numeral 45 in FIGS. 1A and 1B. Recirculation system 45 includes coating solution supply tank 47 as well as a cleaning solution supply tank 49. Recirculation system 45 further includes a pump or pumping arrangement 51, and a valve arrangement which includes a first valve 53 which could be, for example but not limited to, a three-way valve; a second valve 55 which could be, for example but not limited to, a two-way valve; and a third valve 57 which could be, for example but not limited to, a three-way valve.

Recirculation system 45 comprises at least first and second modes of operation. In a first mode of operation which is a coating mode of operation, valve 53 has a first position which is opened to coating solution tank 47 and closed to cleaning solution tank 49. Therefore, coating solution 9 is sucked from coating solution tank 47 by way of pump 51 and supplied to line 100*a*. Valve 55 is in a closed position to prevent the application of coating solution 9 to washing arrangement 40 via line 100*d*. Further, washing arrangement 40 is moved or retracted away from the surface of roller 17 (FIG. 1B). Therefore, pump 51 will deliver coating solution via lines 100*a*, 100*b* to entry port 23 and onto coating solution guide 25. Coating solution guide 25 supplies the coating solution onto roller 17 in the manner described above, which applies the coating solution to photosensitive material 11 as further described above. In the coating mode of operation, coating solution which collects at the bottom of tank 15 will pass through a drain fitting 60, while valve 57 will be in a position closed to drain and open to coating solution tank 47. Thus, coating solution will travel along line 100*c* back into coating solution tank 47 so as to be recycled.

During a period of time, coating solution will tend to dirty rollers 17 and 19 and the remaining components of coating apparatus 7 which come into contact with the coating solution. Further, the properties of the coating solution tends to cause the solution to harden over time. This combination of events either alone or jointly can cause the coating apparatus to leave artifacts on the photosensitive material. Therefore, at intervals, it is necessary to clean the coating apparatus by placing recirculation system 45 in a cleaning mode of operation.

More specifically, recirculation system 45 of the present invention has a second or cleaning mode of operation which operates as follows. Valve 53 is placed in a second position which is closed to coating solution tank 47 and opened to cleaning solution tank 49. Therefore, cleaning solution such as water will be supplied to pump 51. A first advantage of this arrangement is that the cleaning solution will serve to clean the elements of pump 51 as well as valves 53, 55 and 57 from coating solution. Further, valve 55 is placed in an open position to permit the delivery of cleaning solution via lines 100*a* and 100*d* to washing arrangement 40. Additionally, washing arrangement 40 is moved so that brushes 40*b* contact the surface of roller 17 as illustrated in FIGS. 1A and FIG. 2. Cleaning solution will exit from discharge opening 40*c* of scrubber bar 40*a*, such that an initial application of cleaning solution will serve to first clean brushes 40*b*. The brushes 40*b* contacting the surface of roller 17 so as to extend into spaces 29*a* between wire 29, in combination with the application of cleaning solution serves to thoroughly and effectively clean roller 17, including the top surface of wire 29 and spaces 29*a* between wire 29. Also, roller 19 and the remaining components of rack 14 and tank 15 of coating apparatus 7 that come into contact with the cleaning solution will be cleaned. Additionally, the cleaning solution will also pass via line 100*b* into entry port 23 and onto supply guide 25, as well as plate portion 35 and guide members 30 and 31 to clean these components. Further, the cleaning solution is effective to clean the recirculation lines 100*a*–100*e*. Cleaning solution which collects at the bottom of tank 15 will exit via drain fitting 60 to valve 57 and line 100*e* to drain. In the cleaning mode, valve 57 will be in a position which is closed to coating solution tank 47 and open to drain.

After the components of coating apparatus 7 are substantially clean and a substantial amount, depending on the user's preference, of coating solution is removed from the components of coating apparatus 7, washing arrangement 40 is retracted away from the surface of roller 17, such that brushes 40*b* are spaced from the surface of roller 17 (FIG. 1B). Thereafter, valve 53 will be moved back to the first position so as to be opened to coating solution tank 47 and closed to cleaning solution tank 49, valve 55 can be closed so as to prevent the introduction of coating solution to line 100*d* and to washing arrangement 40, and valve 57 can be positioned so as to recycle coating solution back to coating solution tank 47. In this way, coating apparatus 7 will resume operation in the coating mode as previously described.

Accordingly, the present invention provides for a coating apparatus which uniformly applies an even coat of coating solution onto a surface of a photosensitive material. The coating apparatus includes an efficient cleaning assembly which can utilize the same recirculation lines for both coating solution and cleaning solution, and effectively cleans the components of the coating apparatus.

It is recognized that washing arrangement 40 as described above is not limited for use with the specific type of coating apparatus described, but can be applicable to other types of coating apparatuses in which a roller is utilized to apply a coating solution onto a photosensitive material.

The invention has been described in detail with particular reference to certain preferred embodiments thereof, but it will be understood that variations and modifications can be effected within the spirit and scope of the invention.

What is claimed is:

1. An apparatus for applying at least one coating solution to a photosensitive material, the apparatus comprising: support structure;

first and second rollers rotatably mounted on said support structure so as to define a nip therebetween;

a solution supply guide positioned relative to one of said first and second rollers to supply coating solution to said one roller, said one roller applying said coating solution to said photosensitive material as said photosensitive material passes said nip;

a washing arrangement mounted relative to said one roller to apply a cleaning solution onto at least a surface of said one roller, wherein said washing arrangement is a scrubber assembly; and a recirculation system for alternatively supplying cleaning solution to at least said scrubber assembly and coating solution to said solution supply guide.

2. An apparatus according to claim 1, wherein said recirculation system comprises a coating solution tank, a cleaning solution tank and a pump which alternatively pumps coating solution from said coating solution tank to said solution supply guide and cleaning solution from said cleaning solution tank to at least said scrubber assembly.

3. An apparatus according to claim 2, wherein said recirculation system comprises a first valve having a first position for permitting a delivery of coating solution from said coating solution tank to said pump and preventing a delivery of cleaning solution from said cleaning solution tank to said pump, and a second position for preventing a delivery of coating solution from said coating solution tank to said pump and permitting a delivery of said cleaning solution from said cleaning solution tank to said pump.

4. An apparatus according to claim 3, wherein said recirculation system further comprises a second valve having a first position which permits a delivery of cleaning solution from said pump to at least said scrubber assembly when said first valve is in said second position of said first valve, and a second position which prevents delivery of said coating solution from said pump to said scrubber assembly when said first valve is in said first position of said first valve.

5. An apparatus according to claim 4, wherein coating solution and cleaning solution alternatively supplied to said one roller is collected at a drain fitting in said support structure, said recirculation system further comprising a third valve having a first position which in the first position of the first valve and in the second position of said second valve permits a delivery of coating solution collected at said drain fitting back to said coating solution tank and prevents a delivery of said coating solution to a drain, said third valve further having a second position which in the second position of the first valve and in the first position of the second valve prevents a delivery of cleaning solution to said coating solution tank and permits a delivery of cleaning solution to drain.

6. An apparatus for applying at least one coating solution to a photosensitive material, the apparatus comprising:

a support structure;

first and second rollers rotatably mounted on said support structure so as to define a nip therebetween;

a solution supply guide positioned relative to one of said first and second rollers to supply coating solution to said one roller, said one roller applying said coating solution to said photosensitive material as said photosensitive material passes said nip; and a washing arrangement mounted relative to said one roller to apply a cleaning solution onto at least a surface of said one roller;

wherein said one roller is a wired roller having a wire wrapped around said one roller, so as to form spaces between said wire as the wire is wrapped around said one roller.

7. An apparatus according to claim 6, wherein said solution supply guide is positioned relative to said one roller so as to skim off coating solution which extends above the wire on said one roller, and maintain the coating solution in the spaces between the wires.

8. An apparatus according to claim 6, wherein said washing arrangement is a scrubber brush bar having at least one outlet for discharging cleaning solution.

9. An apparatus for applying at least one coating solution to a photosensitive material, the apparatus comprising:

a support structure;

first and second rollers rotatably mounted on said support structure so as to define a nip therebetween;

a solution supply guide positioned relative to one of said first and second rollers to supply coating solution to said one roller, said one roller applying said coating solution to said photosensitive material as said photosensitive material passes said nip;

a washing arrangement mounted relative to said one roller to apply a cleaning solution onto at least a surface of said one roller, wherein said washing arrangement is a scrubber assembly; and a recirculation system having alternating coating and cleaning modes of operations, such that in said coating mode of operation said recirculation system delivers coating solution from a coating solution supply tank to said solution supply guide and recirculates said coating solution back to said coating solution supply tank, and in said cleaning mode of operation said recirculation system delivers cleaning solution to at least said scrubber assembly and collects said cleaning solution for delivery of said cleaning solution to a drain.

10. An apparatus according to claim 9, wherein said scrubber assembly is a retractable scrubber bar with brushes.

11. An apparatus according to claim 10, wherein said retractable scrubber bar is movable between a retracted position in which the brushes are moved away from a surface of said one roller when said recirculation system is in said coating mode of operation, and a cleaning position in which said brushes are moved toward said surface of said one roller when said recirculation system is in said cleaning mode of operation.

* * * * *